United States Patent [19]

Jensen

[11] Patent Number: 4,658,842

[45] Date of Patent: Apr. 21, 1987

[54] RINSING APPARATUS FOR FLAT OBJECTS

[76] Inventor: Lars K. W. Jensen, Risdalsvej 2A, DK-8260 Viby J., Denmark

[21] Appl. No.: 731,494

[22] Filed: May 7, 1985

[30] Foreign Application Priority Data

May 8, 1984 [DK] Denmark ..... 2262/84

[51] Int. Cl.[4] ..... B08B 3/04

[52] U.S. Cl. ..... 134/188; 15/3; 134/193; 366/297; 366/330

[58] Field of Search ..... 134/187, 188, 193; 68/134; 15/3; 366/297, 300, 314, 317, 330, 343

[56] References Cited

U.S. PATENT DOCUMENTS

| | | | |
|---|---|---|---|
| 2,614,699 | 10/1952 | Weisner | 134/193 X |
| 2,825,349 | 3/1958 | Keliher et al. | 134/193 X |
| 2,982,524 | 5/1961 | Bland | 134/193 X |

FOREIGN PATENT DOCUMENTS

| | | | |
|---|---|---|---|
| 686930 | 4/1930 | France | 134/187 |
| 138888 | 1/1953 | Sweden | 134/193 |

*Primary Examiner*—Philip R. Coe

*Attorney, Agent, or Firm*—Sixbey, Friedman & Leedom

[57] ABSTRACT

An apparatus for generally cleaning large and substantially flat objects such as serigraphic printing frames is disclosed. The apparatus comprises a substantially flat vat covered by a lid and adapted to receive a cleaning liquid up to a predetermined level, a number of motor driven paddles located in the vat and having horizontal paddle blades located approximately at the predetermined level and mounted on vertical shafts so as to be rotatable to splash liquid upwardly, and supporting means for the substantially flat objects which comprises an open carrier grate structure mounted horizontally at a level between the paddles and the lid. The paddle blades are specifically shaped to perform an improved splashing function.

4 Claims, 3 Drawing Figures

RINSING APPARATUS FOR FLAT OBJECTS

Figure 1:
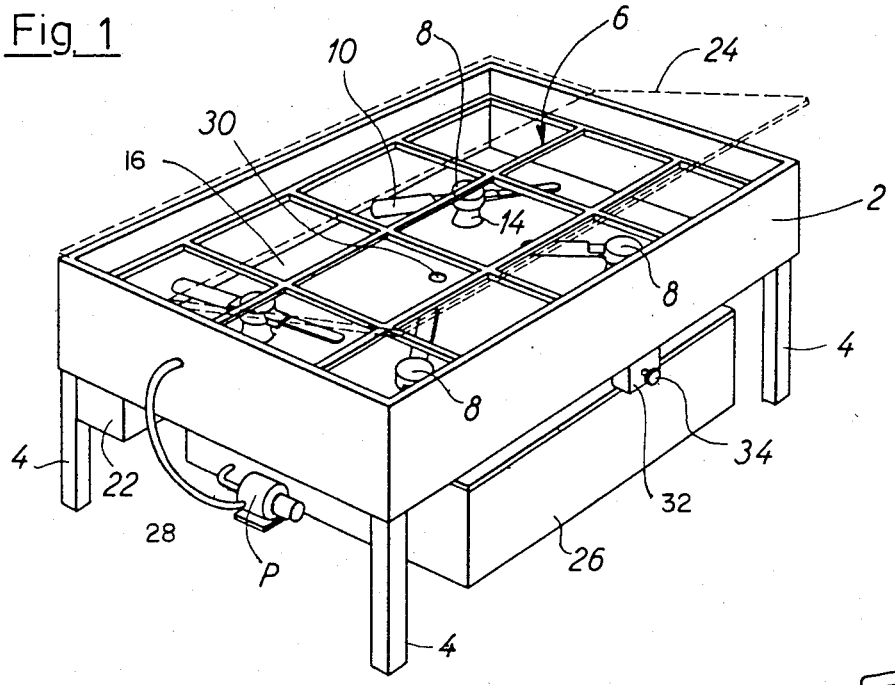

The present invention relates to an apparatus for gently cleaning large and substantially flat workpieces such as serigraphic silk-screen frames.

It has been conventional practice to clean serigraphic printing frames by means of a recirculated cleaning liquid or solvent which through nozzles is sprayed against the workpiece either directly or in connection with soft, rotating brushes. However, this method is disadvantageous because the nozzles are liable to choke, and I have previously invented an improved cleaning apparatus, which is disclosed in the British Patent Specification No. 1,591,370. In that apparatus the flat object to be cleaned is placed on a horizontal carrier grid above a wide surface of the solvent as contained in a flat tray underneath the carrier grid, and a number of rotating paddle blades operate in the surface of the solvent in the tray so as to cause the solvent to be splashed upwardly against the object to be cleaned, generally over the entire lower surface thereof. The solvent contains an amount of macroparticles, e.g. balls of expanded polystyrene, which are slung against the surface of the object along with the solvent itself, and a good cleaning effect is hereby obtainable without any risk of chocked nozzles.

In the said prior apparatus the paddle blades are simple, inclined plate wings, which operate with a certain upthrowing effect on the solvent, and for the efficiency of the apparatus it is of course important that this effect is as high as possible.

According to the present invention the paddle blades are shaped so as to be able to produce an increased upthrowing effect on the solvent and the macroparticles suspended therein, inasfar as it has been found possible to increase this effect beyond the effect of an even optimally inclined paddle blade.

According to the invention use is still made of generally inclined, rotary paddle blades, but each blade is provided with a rear upstanding portion, which may be an upwardly bent rear edge portion, but it is preferably constituted by a rib member welded to the rear edge of the paddle blade. It has been found to be unimportant whether the rear upstanding edge portion forms a smooth continuation of the top surface of the paddle blade or whether it is an abruptly raising portion, e.g. a piece of round iron as secured by welding to and along the rear top edge of the paddle blade.

It has been found, moreover, that a further improvement is achievable when also the peripheral tip portion of the paddle blade is provided with an outermost upstanding edge portion. It is particularly advantageous, however, if the upper and outer corner portion of the paddle blade is left without any such raised rear edge portion.

Figure 2:
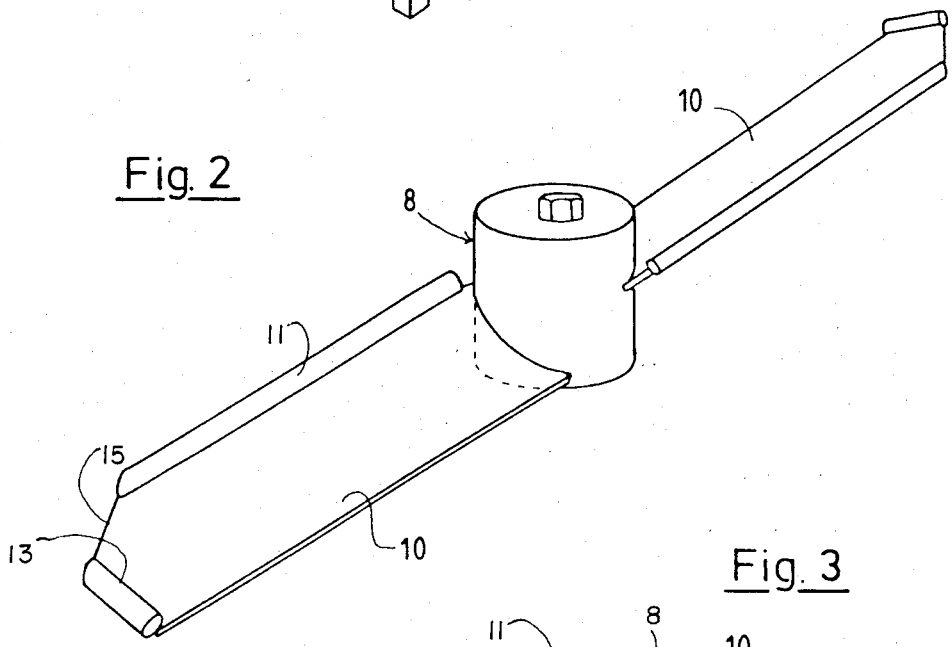
Figure 3:
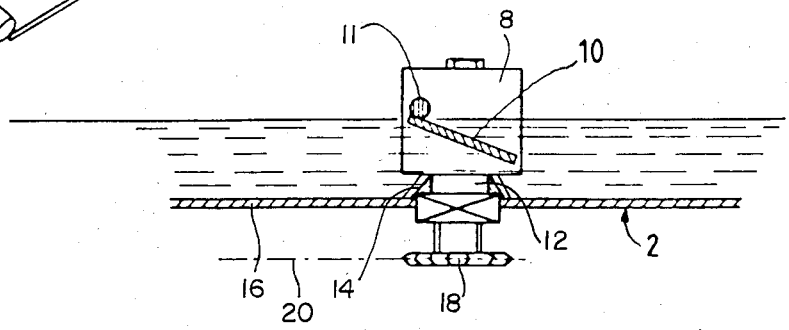

In the following the invention is described in more detail with reference to the drawing, in which:

FIG. 1 is a perspective view of a cleaning machine for serigraphic printing frames, FIG. 2 is a perspective view of a paddle rotor used in the apparatus, and FIG. 3 is a plan side view of the paddle rotor.

The apparatus shown in FIG. 1 comprises a flat, upper vat 2 supported by legs 4 and slightly below its top edge provided with a horizontal carrier grate structure 6 on which the article or articles to be cleaned can be placed, e.g. a silk-screen frame and (in a carrier basket not shown) various printing tools as wipers and scrapers. In the bottom of the vat is arranged a number of rotors 8 having horizontally projecting paddle blades 10 rotating with vertical shafts 12, which (see FIGS. 1 and 3) are let down through raised dome shaped portions 14 of the bottom 16. At their lower ends the shafts 12 are provided with chain wheels 18 driven by a common chain 20 by a motor 22. The vat is covered by a lid 24 shown in dotted lines in FIG. 1, and preferably constructed such that a front portion thereof may be swung up sufficiently to allow the cleaning articles to be taken in and out. Holding means (now shown) may be arranged to temporarily hold the lid in an inclined, open position allowing the articles to be taken in and out, without giving rise to any considerable vapour outlip from the vat.

Underneath the vat 2 is arranged a tank 26 for solvent, which is feedable to the vat through a pipe 28 and a pump P. The vat has a bottom outlet 30 connected to the top of the tank via a valve 32 with valve handle 34 (FIG. 1). In the bottom of the tank 26 is mounted a sludge tray (not shown) which may be lifted off from the tank for being emptied, the tank being closed by a removable lid 40. Moreover, an overrun connection (not shown) may be established from the vat to the tank.

When the apparatus is to be used practically the entire volume of solvent in the tank 26 is pumped up into the vat in which the liquid level will be flush with or slightly above the level of the paddle blades 10. The workpiece to be cleaned is laid on the grate 6, and the motor 22 is started, whereby the paddle blades will splash solvent upwardly against the workpiece. Preferably the workpiece or pieces should not entirely cover the grate 6, so that some solvent is even splashed up in the space between the lid and the top side of the workpiece to cause a cleaning effect also on said top side by the violent turbulence of the solvent slung up by the paddle blades. In case of a silk-screen frame the side thereof having faced the printed surface by the printing operation will not normally need any high amount of cleaning, and when this side is oriented upwardly on the grate 6 the frame will normally be cleanable in a satisfactory manner without being turned on the grate.

In FIG. 2 is shown a two-bladed paddle rotor 8 having inclined paddle blades 10, along and above the raised rear edges of which there is mounted a piece of round iron 11, which is secured to the paddle blade by welding. Correspondingly a piece of round iron 13 is welded to the tip area of each paddle blade. The upper and outer corner area portion of each paddle blade is cut away as shown at corner edge 15 such that a corner opening occurs between the upstanding round iron ribs 12 and 14.

It is shown in FIG. 3 that the paddle blades should preferably work in a solvent bath, the top side of which is located in level with the transition between the blades 10 and their upstanding rear edge ribs 11. The surface of the liquid may be somewhat lower, but preferably not lower than down to approximately the half of the height dimension of the inclined paddle blades.

What is claimed is:

1. An apparatus for generally cleaning large and substantially flat objects such as serigraphic printing frames, comprising a substantively flat vat covered by a lid and adapted to receive a cleaning liquid up to a predetermined level, a number of motor driven paddles located in the vat and having horizontal paddle blades located approximately at said predetermined level and mounted on vertical shafts so as to be rotatable to splash liquid upwardly, and supporting means which comprises an open carrier grate structure mounted horizontally at a level between the paddles and the lid, wherein the paddle blades are each provided with a front edge, a rear edge, an outer tip edge between the front and rear edges, an upstanding rib along at least the major extent of the rear edge and an upstanding rib provided along the outer tip edge wherein the upstanding rib along the rear edge terminates short of said tip edge, and an outer rear corner opening is provided between the upstanding ribs of the blade.

2. An apparatus according to claim 1, in which a rear end of the rib along a tip edge is spaced from the outer rear corner of the blade.

3. An apparatus for generally cleaning large and substantially flat objects such as serigraphic printing frames, comprising a substantively flat vat covered by a lid and adapted to receive a cleaning liquid up to a predetermined level, a number of motor driven paddles located in the vat and having horizontal paddle blades located approximately at said predetermined level and mounted on vertical shafts so as to be rotatable to splash liquid upwardly, and supporting means which comprises an open carrier grate structure mounted horizontally at a level between the paddles and the lid, wherein the paddle blades are each provided with a front edge, a rear edge, an outer tip edge between the front and rear edges, a corner edge between the outer tip edge and the rear edge, and an upstanding rib along at least the major extent of the rear edge, and along the tip edge of the paddle blade except in the area of said corner edge of the blade.

4. An apparatus for generally cleaning large and substantially flat objects such as serigraphic printing frames, comprising a substantively flat vat covered by a lid and adapted to receive a cleaning liquid up to a predetermined level, a number of motor driven paddles located in the vat and having horizontal paddle blades located approximately at said predetermined level and mounted on vertical shafts so as to be rotatable to splash liquid upwardly, and supporting means which comprises an open carrier grate structure mounted horizontally at a level between the paddles and the lid, wherein the paddle blades each have a rear edge provided with an upstanding rib portion along at least the major extent thereof, and in which the upstanding rib is a piece of round iron secured to the blade by welding.

* * * * *